US008572929B2

(12) United States Patent
Stumm

(10) Patent No.: US 8,572,929 B2
(45) Date of Patent: Nov. 5, 2013

(54) WINDOW OR DOOR ELEMENT

(71) Applicant: Architectural Traditions LLC, Tucson, AZ (US)

(72) Inventor: Wolfgang Stumm, Lugano (CH)

(73) Assignee: Architectureal Traditions LLC, Tucson, AZ (US)

( * ) Notice: Subject to any disclaimer, the term of this patent is extended or adjusted under 35 U.S.C. 154(b) by 0 days.

(21) Appl. No.: 13/651,558

(22) Filed: Oct. 15, 2012

(65) Prior Publication Data

US 2013/0125505 A1 May 23, 2013

(30) Foreign Application Priority Data

Oct. 13, 2011 (DE) ..... 20 2011 106 732 U

(51) Int. Cl.
*E06B 7/16* (2006.01)
*E06B 7/28* (2006.01)

(52) U.S. Cl.
USPC ..... 52/783.1; 52/212; 52/405.4; 52/407.4; 52/796.1; 52/794.1; 52/204.71

(58) Field of Classification Search
USPC ..... 52/210–213, 204.52, 171.1, 243.1, 52/207–208, 204.1, 204.54, 204.5, 782.1, 52/783.1, 786.11, 787.1, 796.1, 792.11, 52/792.1, 794.1, 404.1, 405.4, 407.2, 52/407.4, 204.71
See application file for complete search history.

(56) References Cited

U.S. PATENT DOCUMENTS

| | | | | |
|---|---|---|---|---|
| 3,487,580 | A * | 1/1970 | Holliday | 49/372 |
| 4,195,456 | A * | 4/1980 | Hickman et al. | 52/208 |
| 5,418,021 | A * | 5/1995 | Kim | 428/14 |
| 7,520,093 | B2 * | 4/2009 | Guhl | 52/204.1 |
| 8,024,907 | B2 * | 9/2011 | McKinlay et al. | 52/786.1 |
| 2006/0260229 | A1 * | 11/2006 | McKinlay et al. | 52/204.593 |
| 2008/0122324 | A1 * | 5/2008 | Bienick | 312/116 |

FOREIGN PATENT DOCUMENTS

PL 390899 A1 * 10/2011

* cited by examiner

*Primary Examiner* — Jeanette E. Chapman
(74) *Attorney, Agent, or Firm* — Collard & Roe, P.C.

(57) ABSTRACT

In the case of a window or door element (1) having a metal frame and an insulated glass pane (7) inserted into the frame (2), a solution is to be created, with which such window or door elements can be produced without requiring cold-forming, extrusion production of light-metal profiles, or another form of production of the frame elements. This is achieved in that the outer and/or inner surface of the frame (2) is formed, in each instance, by a flat metal frame (4, 5), wherein an insulation body (3) is positioned between the frame elements (4, 5), using sandwich construction.

11 Claims, 4 Drawing Sheets

WINDOW OR DOOR ELEMENT

CROSS REFERENCE TO RELATED APPLICATIONS

Figure 1:
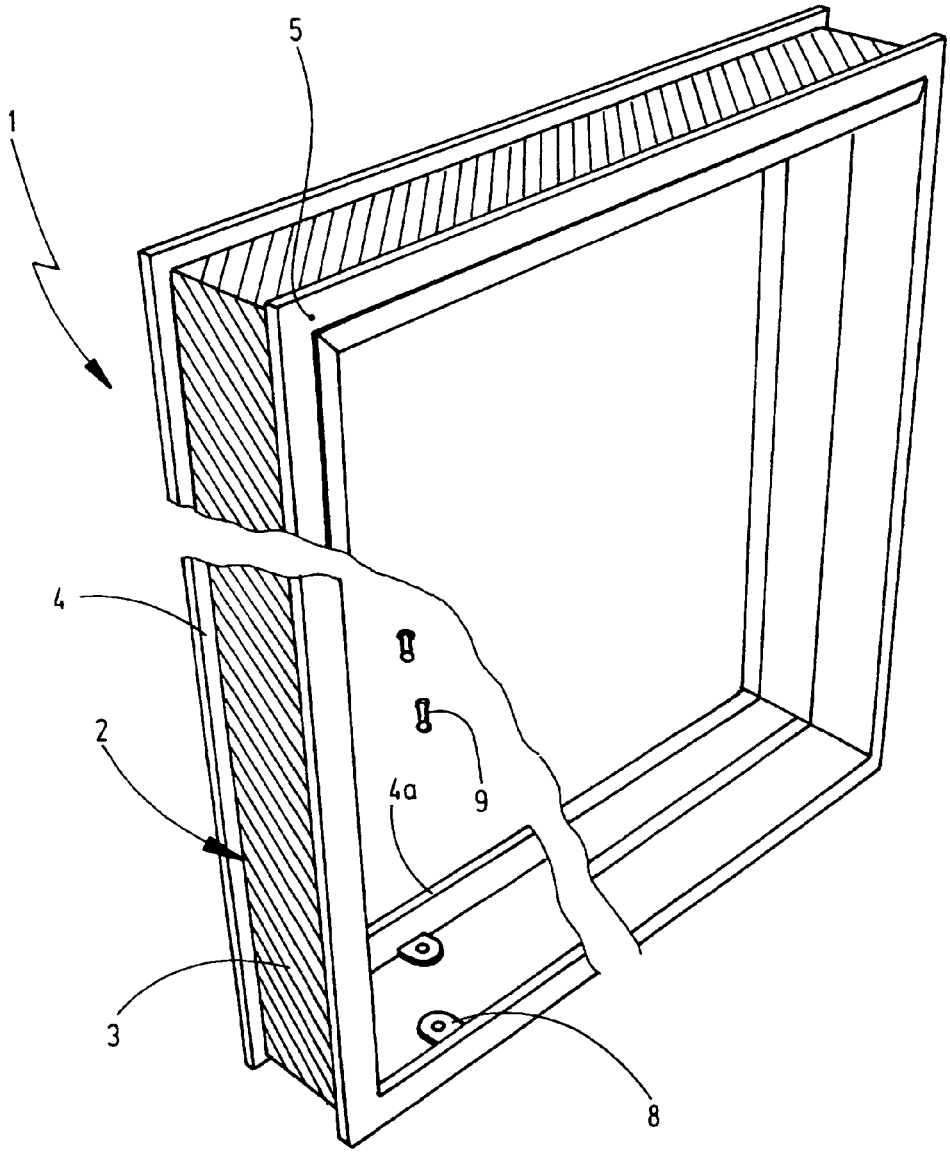

Applicant claims priority under 35 U.S.C. §119 of German Application No. 20 2011 106 732.0, filed on Oct. 13, 2011, the disclosure of which is incorporated by reference.

The invention is directed at a window or door element having a metal frame and an insulated glass pane inserted into the frame.

The metal frames of such window and door elements are generally produced from hollow profiles, whereby it is known to use so-called insulated profiles, so that the outer metal frame surface is heat-insulated relative to the inner metal frame surface. These profiles are joined together to form a frame, in which the corners are frequently mitered. The insulated glass panes are then inserted into a frame produced in this manner, whereby the profile shapes of the frame elements can be configured very differently.

The production of such frame profiles can take place either by way of cold-forming of metals, or also in that aluminum profiles, for example, are continuously produced using the extrusion process.

It is the task of the invention to create a solution in which such window or door elements can be produced without requiring cold-forming, extrusion production of light-metal profiles, or another form of production of the frame elements.

In the case of a window or door element of the type indicated initially, this task is accomplished, according to the invention, in that the outer and/or inner surface of the frame is formed, in each instance, by a flat metal frame, whereby an insulation body is positioned between the frame elements, using sandwich construction, whereby it can particularly be provided that the outer and/or inner surface of the frame is formed, in each instance, from a flat metal frame cut out from a planar metal plate or a metal strip, whereby an insulation body is positioned between the frame elements, using sandwich construction.

With the invention, an element is created that is just as suitable as a window or door element and as a fixed element without a casement function; lifting/sliding doors and the like can be produced in the same manner.

The insulation body positioned between the flat metal frames can consist of very different materials in this connection. For example, of GFRP (glass-fiber-reinforced plastic), of glass-fiber-reinforced polyamide, of polyurethane, and similar materials. In this connection, the sandwich construction makes particularly efficient production possible.

Further embodiments of the invention are evident from the dependent claims. In this connection, it can be provided that the insulation body is formed from a rod material, whereby the rods are connected with one another in frame-like manner.

In this connection, the rod material does not necessarily have to be joined together to form a closed frame ahead of time. This frame can also be produced in that the individual rods are individually positioned on a corresponding flat metal frame and connected with it, while they then form a frame as an intermediate layer.

According to the invention, it can also be provided that the face surfaces of the insulation body are equipped with adhesive and/or with adhesive strips for fixation of the flat metal frames that lie on them. This adhesive and/or adhesive strip connection generally serves as an assembly aid, because the flat metal frames are also equipped with attachment tabs for rivets, screws, or the like, for attachment to the insulation body, as the invention also provides. Silicone adhesive, for example, can be used as an adhesive, to mention one example.

In a practical embodiment, the flat metal frame is attached to the insulation body in that the flat metal frame is equipped with welded bolts and the insulation body is equipped with corresponding dead-end bores, into which the welded bolts can engage for fixation.

Another embodiment of the invention can particularly consist in that the inner cutout of the outer flat metal frame is slightly smaller than the inner cutout of the inner flat metal frame, in order to form a circumferential contact ridge for the insulated glass pane.

In order to produce the inner cutouts, the flat metal frame can be cut out by means of a laser, but other production methods are also possible here, such as water-jet cutting, gas cutting, or plasma cutting, or also mechanical cutting, for example, using nibbling machines.

The invention also provides that the contact ridge for the insulated glass pane formed by the outer flat metal frame is equipped with an adhesive and/or with an adhesive strip, whereby it can also be provided that the surface of the insulated glass pane that faces inward is equipped, on its outer edge, with an adhesive and/or an adhesive strip, for fixation of a glass holding frame.

In order to achieve an optically very appealing appearance, it can also be provided, according to the invention, that the insulated glass pane is directly fixed in place in the insulation body, with flat metal frames that are applied subsequently.

Furthermore, it is provided that the insulation body is equipped with a so-called "Euro-groove" for attachment of the window or door hardware.

Further details, characteristics, and advantages of the invention are evident from the following description and from the drawings. These show, in FIG. 1 the spatial representation of a window or door element with a partly equipped corner, without glazing, FIG. 2 a partial exploded drawing in a spatial representation of the window or door element, FIG. 3 a complete exploded representation in a spatial representation of the window or door element of a first embodiment, and in FIG. 4 a complete exploded representation in a spatial representation of the window or door element of a modified embodiment.

The window or door element, indicated in general with 1, referred to below only as "window element 1," has a frame 2 produced using sandwich construction, whereby an inner insulation body 3 is positioned between an outer flat metal frame 4 and an inner flat metal frame 5, as is particularly evident from FIGS. 1 and 2.

The flat metal frames 4 and 5 are equipped, in the example shown, with an inner cutout, referred to in general with 6, that is slightly different in size, in such a manner that in the case of the inner flat metal frame, an insulated glass pane, referred to in general with 7, can be pushed through, while the inner cutout of the outer flat metal frame 4 has a cutout that is smaller by a certain dimension, in such a manner that a contact ridge, referred to with 4', projects inward into the inner cutout 6, in order to be able to position the glass pane 7 there, so that it cannot come loose.

Figure 2:
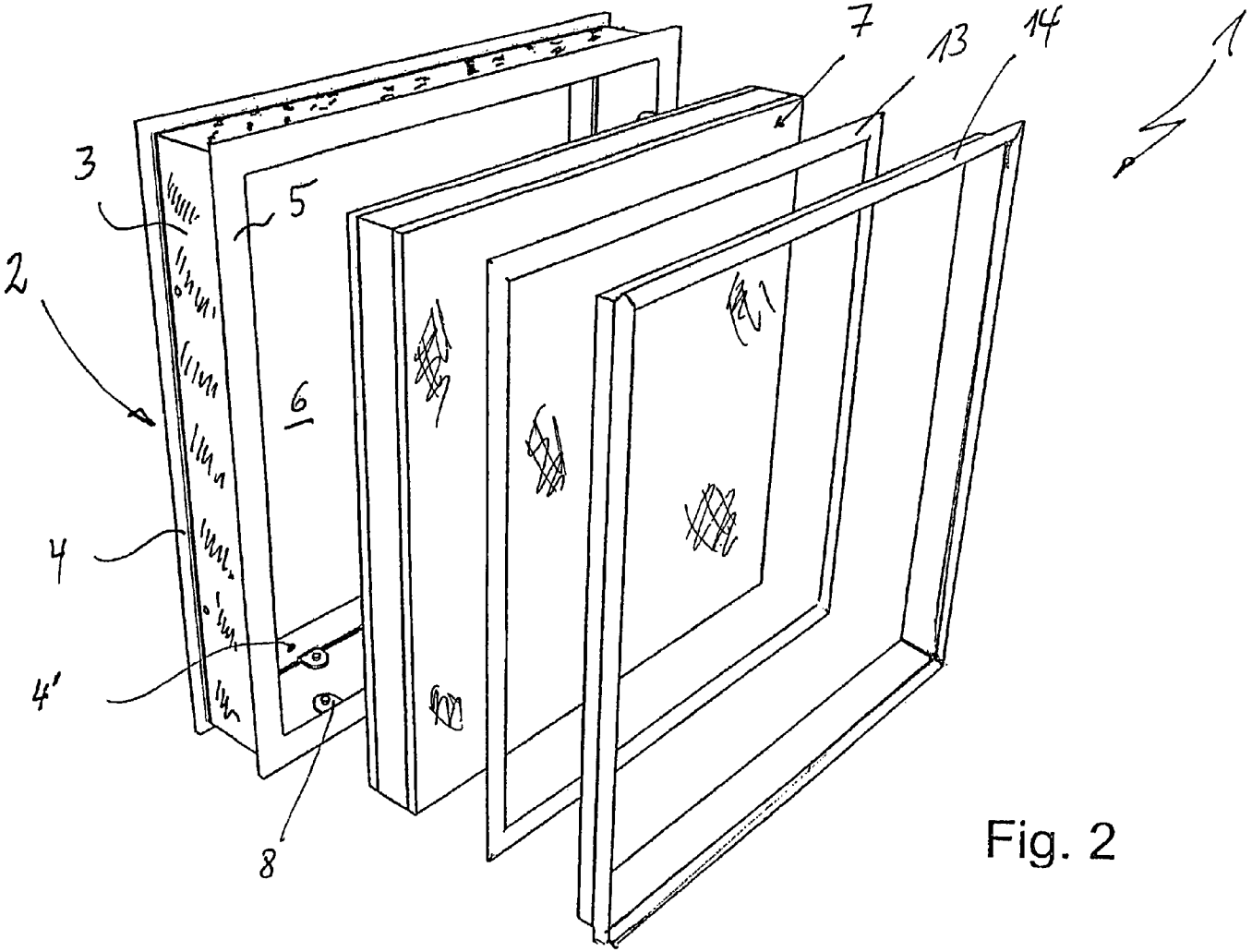

Tabs 8 are attached, for example welded, to the flat metal frame, which tabs point inward at right angles in the position of use, in such a manner that these flat metal frames can be fixed in place there by means of rivets 9, for example, as is evident, for example, from FIG. 1, in the left figure cutout. For fixation or for facilitating assembly of the individual elements, adhesives strips or adhesive webs are shown, in the example shown, whereby according to FIG. 3, first an adhesive strip 10 is shown, in the figure from left to right, which strip is glued onto the edge region 4*a* of the outer flat metal frame element 4, which faces inward, in order to fix the pane 7 in place.

Figure 3:
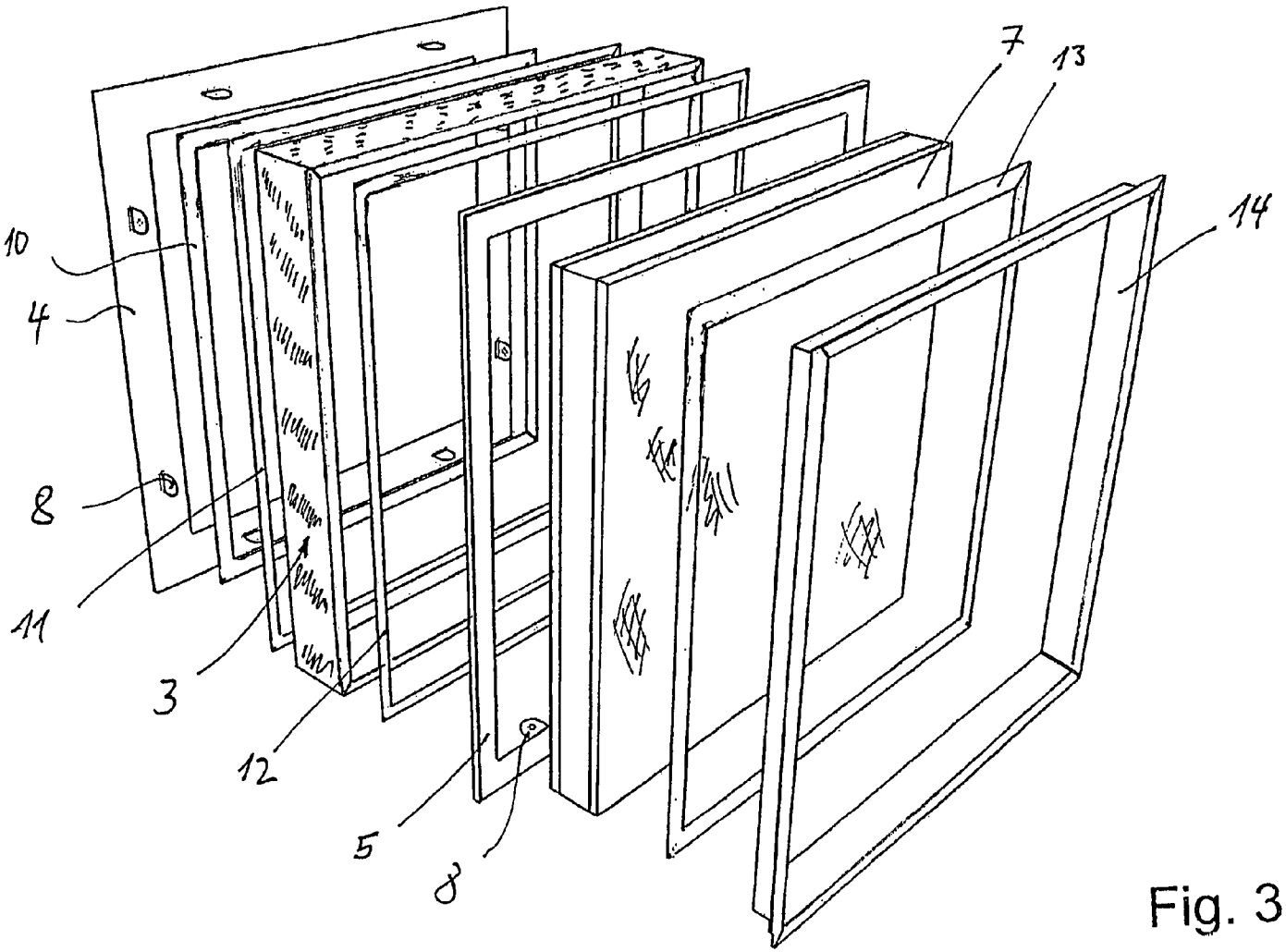

The face sides of the insulation body 3 are equipped, according to FIG. 3, with an adhesive strip 11 and 12, in each instance, in order to first fix the insulation body 3 in place on the flat metal frame 4 or 5, respectively during assembly, before they are riveted or screwed in place. Once the pane 7 has been installed, its surface that faces inward can be provided with another adhesive strip 13 on its outer edge, in order to be able to fix a glass holder frame 14 in place there.

Figure 4:
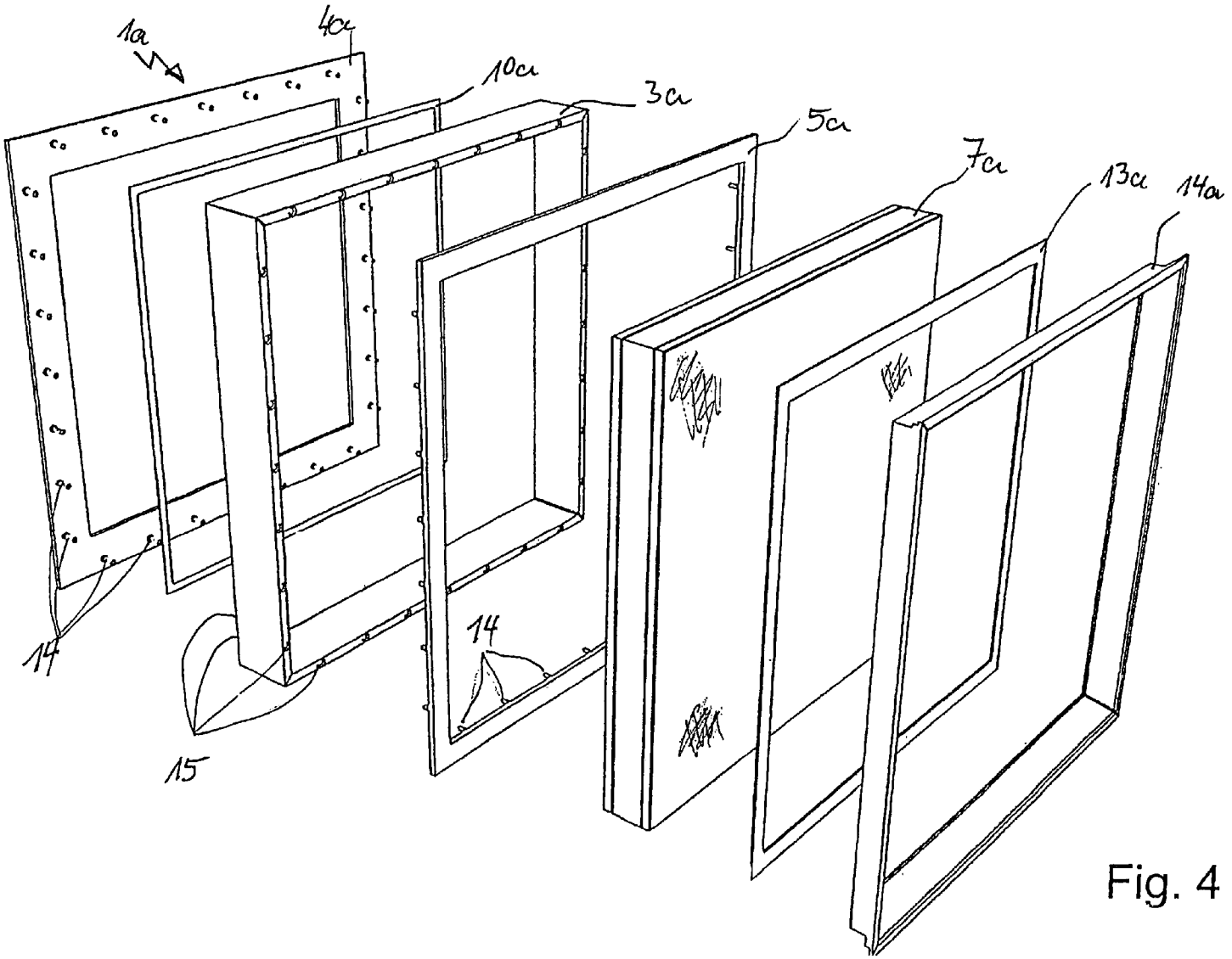

In the embodiment according to FIG. 4, all the elements that agree with the elements according to the embodiment according to FIG. 1 are provided with the same reference symbol, but with an "a" added. In contrast to the embodiment according to FIG. 1 ff, the outer flat metal frame 4*a* of the window or door element 1*a* is equipped with welded bolts 14 that are positioned vertically, which are positioned in the direction of the GFRP frame 3*a*. This also applies analogously for corresponding welded bolts on the inner flat metal frame 5*a*, whereby the GFRP frame is provided, on its two face surfaces, with a corresponding number of dead-end bores 15, into which the welded bolts 14 engage during assembly. For the remainder, the method of production and assembly is the same as for the embodiment according to FIG. 1 ff. No screw connections or the like are required, because of the welded bolts 14 that engage into the dead-end bores 15, and this particularly facilitates assembly and therefore makes it less expensive.

Of course, the exemplary embodiments of the invention as described can still be modified in many aspects. For example, the insulation body 3 can have a corresponding groove for fixation of hardware; the glass holder frame can particularly be eliminated if the glass pane itself is enclosed by means of correspondingly pre-formed elements of the insulation body and then permanently fixed in place in the flat metal frame, whereby then, the inner and the outer flat metal frame can have an inner opening 6 that is the same size. Instead of the adhesive strips shown schematically here, silicon adhesives can, of course, be applied analogously, in order to fix the individual elements in place, and more of the like.

REFERENCE SYMBOL LIST

1 Window or Door Element
2 Frame
3 Insulation Body
4 Outer Flat Metal Frame
4*a* Contact Ridge
5 Inner Flat Metal Frame
6 Inner Cutout
7 Glass Pane
8 Tabs
9 Rivets
10 Adhesive Strip
11 Adhesive Strip
12 Adhesive Strip
13 Adhesive Strip

The invention claimed is:

1. A window or door element having a metal frame and an insulated glass pane inserted into the frame, wherein the frame comprises an outer flat metal frame having an inner cutout, an inner flat metal frame having an inner cutout, and an insulation body positioned between the outer flat metal frame and the inner flat metal frame, using sandwich construction; and wherein the inner cutout of the outer flat metal frame is slightly smaller than the inner cutout of the inner flat metal frame, in order to form a circumferential contact ridge for the insulated glass pane.

2. The window or door element according to claim 1, wherein each of the outer flat metal frame and the inner flat metal frame is formed by being cut out from a planar metal plate or a metal strip.

3. The window or door element according to claim 1, wherein the insulation body is formed from rods, wherein the rods are connected with one another in frame-like manner.

4. The window or door element according to claim 1, wherein the insulation body has face sides equipped with adhesive and/or adhesive strips for fixation of the flat metal frames that lie on them.

5. The window or door element according to claim 1, wherein the flat metal frames are equipped with attachment tabs for rivets, screws, or the like, for attachment to the insulation body.

6. The window or door element according to claim 1, wherein the flat metal frames are equipped with welded bolts for attachment to the insulation body, which is provided with dead-end bores.

7. The window or door element according to claim 1, wherein the inner cutouts of the flat metal frames are cut out via a laser.

8. The window or door element according to claim 1, wherein the contact ridge for the insulated glass pane formed by the outer flat metal frame is equipped with an adhesive and/or with an adhesive strip.

9. The window or door element according to claim 1, wherein the insulated glass pane has a surface that faces inward and is equipped, on its outer edge, with an adhesive and/or with an adhesive strip for fixation of a glass holding frame.

10. The window or door element according to claim 1, wherein the insulated glass pane is directly fixed in place on or in the insulation body, and the flat metal frames are applied subsequently.

11. The window or door element according to claim 1, wherein the insulation body is equipped with a standardized "Euro-groove" for attaching the window or door hardware.

* * * * *